US006007422A

United States Patent [19]

Van Becelaere

[11] Patent Number: 6,007,422

[45] Date of Patent: Dec. 28, 1999

[54] UNIVERSAL DAMPER MOUNTING SYSTEM AND METHOD

[75] Inventor: Robert M. Van Becelaere, Lake Lotawana, Mo.

[73] Assignee: Tomkins Industries, Inc., Dayton, Ohio

[21] Appl. No.: 09/159,355

[22] Filed: Sep. 23, 1998

[51] Int. Cl.[6] ..... F24F 13/18

[52] U.S. Cl. ..... 454/273; 248/906; 454/331

[58] Field of Search ..... 454/271, 273, 454/278, 331, 332; 248/906

[56] References Cited

U.S. PATENT DOCUMENTS

| | | | |
|---|---|---|---|
| 915,133 | 3/1909 | Waterbury | 454/331 |
| 935,187 | 9/1909 | Burgess | 454/331 |
| 2,751,173 | 6/1956 | Fredriksen | 248/906 X |
| 4,108,414 | 8/1978 | Grant, Sr. | 248/906 X |
| 4,515,068 | 5/1985 | Van Becelaere . | |
| 4,524,678 | 6/1985 | Klebanoff . | |
| 4,669,371 | 6/1987 | Sarazen, Jr. et al. | 454/276 |
| 4,693,438 | 9/1987 | Angell | 248/906 X |

*Primary Examiner*—Harold Joyce
*Attorney, Agent, or Firm*—Litman, Kraai & Brown L.L.C.

[57] ABSTRACT

A universal damper mounting system and method for mounting a damper within an opening in a wall includes the use of a plurality of metal straps, each of which is initially formed into an roughly S shape with one leg being longer than the thickness of a wall into which the damper is being installed and also being longer than an opposite leg. The damper includes a rectangular housing with top and bottom peripheral sealing flanges on one side of the housing. A first pair of the straps are abutted against the top sealing flange and a second pair are abutted against the bottom sealing flange with the opposite leg of each strap being folded over a respective one of the top or bottom sealing flanges. The damper is then placed in the wall opening and the terminal ends of the long legs of each strap are bent upward or downward, depending upon the position, to overlap the wall surface. The straps thus serve to retain the damper in the wall.

6 Claims, 2 Drawing Sheets

12
5
22
23
1
14
15
15
11
21

UNIVERSAL DAMPER MOUNTING SYSTEM AND METHOD

FIELD OF THE INVENTION

The present invention relates to a universal system and method for mounting a damper within a wall opening, and, more particularly, to such a method in which a plurality of S shaped metal straps are provided, preferably two on top of the damper housing and two on the bottom thereof. One leg of each strap protrudes outward past a front of the damper and is then bent around a peripheral sealing flange of the damper housing and an opposite, longer leg of each strap protrudes past a wall surface opposite the sealing flanges and the terminal end of the opposite leg of each strap is bent at a 90 degree angle to overlap the wall surface to thus secure the damper housing within the wall opening.

BACKGROUND OF THE INVENTION

In modern buildings, a variety of dampers are positioned at ventilation inlets, HVAC air supply inlets and returns, for fire dampers between rooms and hallways, etc. Each damper is typically positioned in a rectangular opening in a wall and includes one or more blades or vanes which are selectively movable between full open and completely closed positions to control air flow there through. In the past, the system and method used for installing such dampers the system and method used for installing such dampers varied depending upon the type of wall into which they were being installed. For example, U.S. Pat. No. 4,515,068, invented by the applicant and assigned to the present assignee, describes and illustrates a damper and mounting system for use in a concrete or masonry wall opening. In the '068 patent, the damper includes a peripheral frame with a plurality of internally threaded tubes attached to the frame peripheral walls and positioned over respective openings in the peripheral walls. A respective self-tapping, externally threaded stud is positioned within each such tube such that the studs can be turned, as by a wrench or the like, and threaded outward through the tube and into engagement with the sides of the wall opening. Two or more of the tubes and studs are required for each damper to secure it to the wall opening.

U.S. Pat. No. 4,524,678, of Steven Klebanoff, also assigned to the present assignee, describes and illustrates a damper and mounting system for use in a conventional stud and sheet rock wall. In the '678 patent, a respective sheet steel strap is secured to the side of a damper housing, with the strap lying flat against the side of the housing. As the damper is inserted into a framed opening within a stud wall, the straps lie across vertically oriented studs on either side of the damper. Each end of each strap is then bent outward at a ninety degree angle to abut either side of the respective vertically oriented stud. The straps then hold the damper against the studs to retain it in the wall opening.

In addition, both the '068 patent and the '678 patent illustrate prior art attachment methods which include four angle members respectively attached to the top and bottom of the damper housing on either side of the damper, with each angle member being attached to the damper housing and the wall. This prior art method, although usable with either stud or masonry walls, is time and labor consuming, making installation and removal difficult, particularly in the relatively tight quarters typically found in damper installations.

By contrast, the systems and methods described and illustrated in the '068 and '678 patents, while making the installation and removal of dampers convenient, are each designed for a particular type of wall construction. Thus, installers get equipment and jobs mixed up since different installation systems must be used for different wall types.

It is clear then, that a need exists for an improved damper installation system and method. Such a system and method should allow for convenient and quick damper installation and should be universal to any type of wall construction.

SUMMARY OF THE INVENTION

The present invention is directed to a universal damper mounting system and method for mounting a damper within an opening in a wall. The damper includes a rectangular housing forming an opening with the pivoting vanes or blades contained therein and with a top and bottom peripheral sealing flange on one side of the housing. The system and method includes the use of a plurality of metal straps with each of the straps being initially formed into an roughly S shape with a first leg being longer than the depth of a wall into which the damper is being installed. Each strap has an intermediate second leg and a shorter third leg, with the first leg being of a length to extend entirely through the wall and extend a significant distance out the side of the wall opposite the sealing flanges when the intermediate leg is abutting one of the sealing flanges. A pair of the straps are placed atop the damper housing and a pair of the straps are placed along the bottom of the housing with the intermediate legs of each strap abutting a respective one of the sealing flanges and with the third leg of each strap being folded over that sealing flange. The terminal end of the first leg of each strap is then bent upward or downward depending upon the position, to overlap a portion of the wall surface. The straps, thus bent at one end over the respective damper sealing flange and at the other end overlapping the wall surface, act to retain the damper in the wall opening.

OBJECTS AND ADVANTAGES OF THE INVENTION

The principal objects of the present invention include: providing a universal damper installation system and method; providing such a system and method which is usable with any type of wall construction to install a damper within that wall; providing such a system and method which allows the quick and convenient, yet reliable installation of the damper within a wall opening; providing such a system and method which is economical and flexible; and providing such a system and method which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 5:
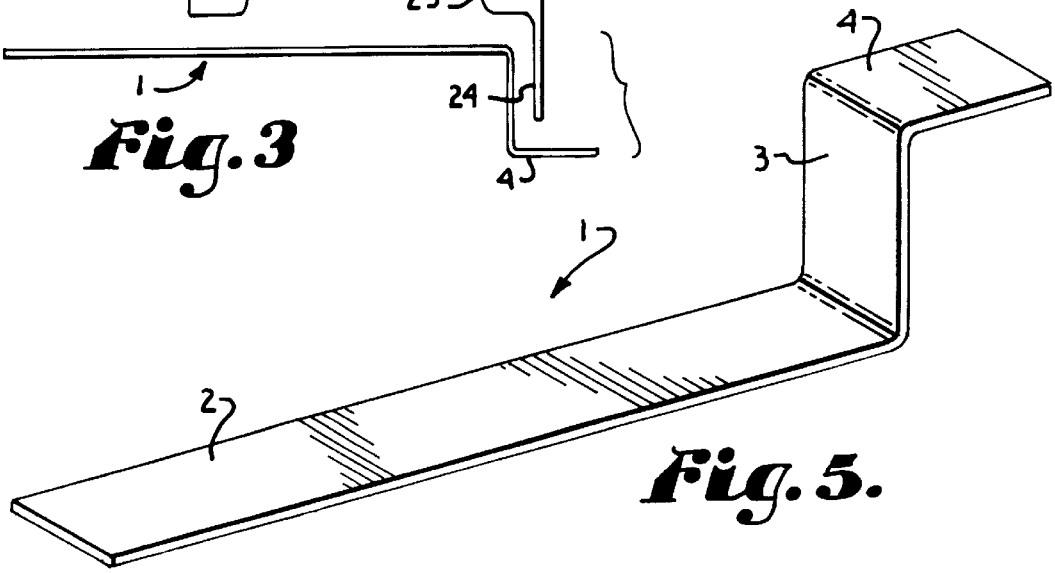
FIG. 5 is a perspective view of one of the installation straps, again prior to being bent during installation.

Referring to FIGS. 1–5, a universal damper mounting system and method for mounting a damper within an opening in a wall is illustrated. The system and method includes the use of a plurality of metal straps 1, each of which is preferably initially formed into an roughly S shape, as shown in FIG. 5. Each of the S shaped straps 1 includes a first leg 2 which is significantly longer than an intermediate second leg 3 and an opposite, third leg 4.

Figure 1:
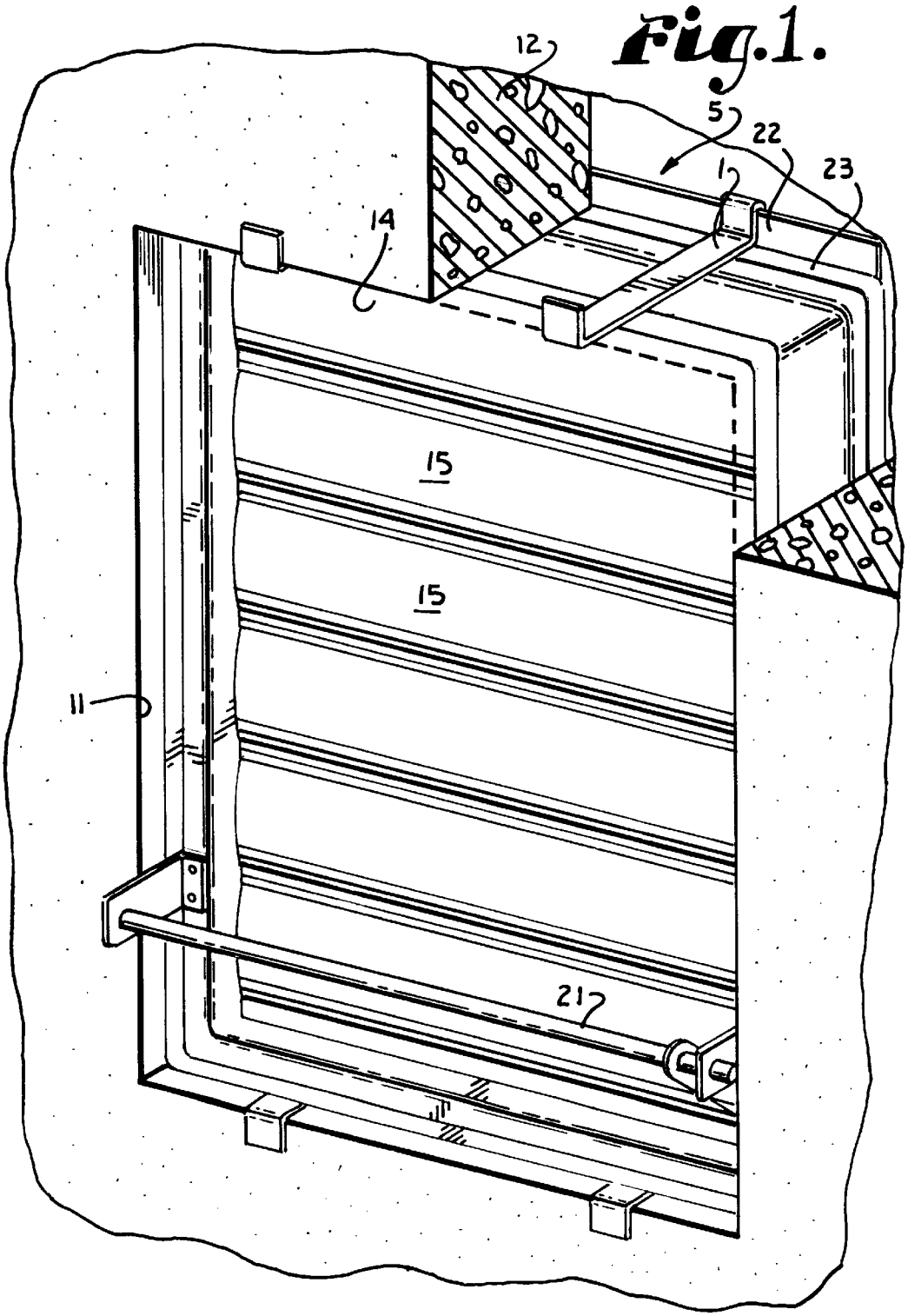
FIG. 1 is a perspective view of a damper installed within an opening in a concrete wall via the inventive installation system and method, with portions of the wall broken away to illustrate one of the straps.
Figure 2:
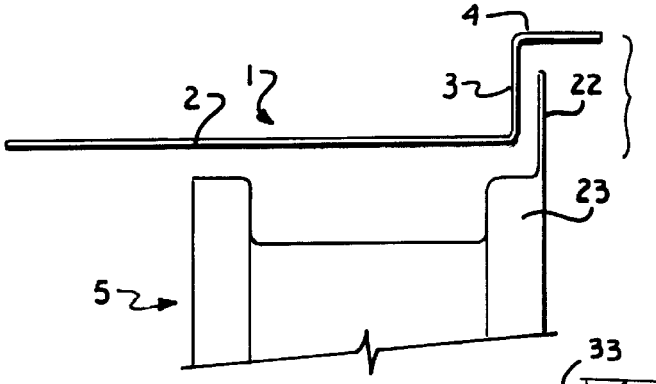
FIG. 2 is a greatly enlarged, fragmentary side elevational view of the top of the damper of FIG. 1, with one of the installation straps positioned thereon prior to being bent during installation.
Figure 4:
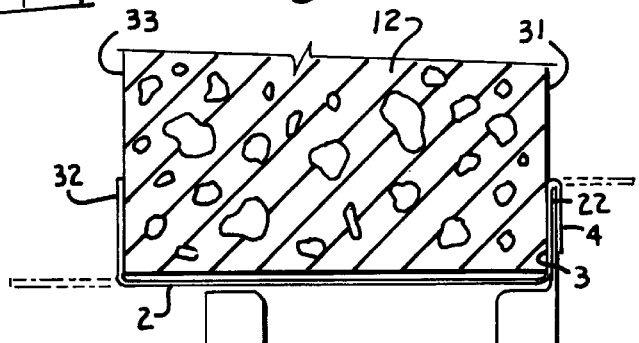
FIG. 4 is a greatly enlarged, fragmentary side elevational view of the top of the damper of FIG. 1, shown installed in the wall and with one of the installation straps shown in solid lines after being bent about the sealing flange and about the wall, and in dotted lines prior to such bending action.
Figure 3:
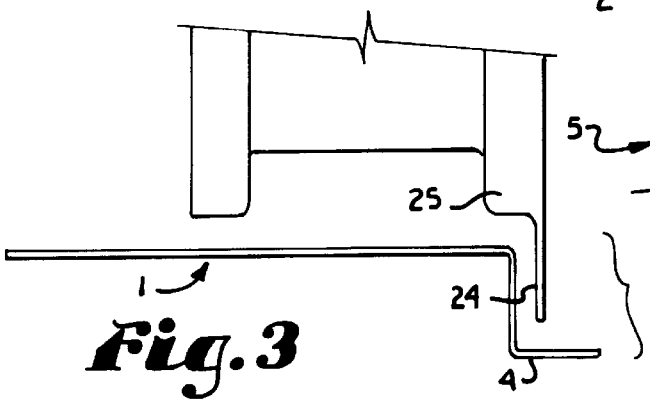
FIG. 3 is a greatly enlarged, fragmentary side elevational view of the bottom of the damper of FIG. 1, with one of the installation straps positioned thereon prior to being bent during installation.

Referring to FIGS. 1–3, a damper 5 is illustrated installed within a wall opening 11 of a concrete wall 12. It should be noted that the concrete wall 12 is merely illustrative, and that the present system is usable with any type of wall construction. The damper 5 includes a generally rectangular housing 13 forming an opening 14 with a plurality of pivoting vanes 15 contained therein. The vanes 15 are selectively movable between a closed configuration, as illustrated, and an open configuration in conventional fashion via a conventional vane operating mechanism 21. The housing 13 includes an upper peripheral sealing flange 22 along a top front portion 23 thereof and a bottom peripheral sealing flange 24 along a bottom peripheral portion 25 thereof. A pair of the straps 1 are first laid atop housing 13 and an additional pair of straps 1 are positioned along a bottom of the housing 13. With each of the straps 1, the third leg 4 is then bent over the respective upper or lower sealing flange 22 or 24 to retain the straps 1 onto the housing 13. The housing 13, along with the attached straps 1, is then pushed into the wall opening 11 until the sealing flanges 22 and 24 are positioned against a rear surface 31 of the wall 12, as illustrated in FIG. 1. Each of the straps 1 thus has a terminal portion 32 of its long first leg 2 extending outward past a front surface 33 of the wall 12, as shown in phantom lines in FIG. 5. To complete the installation of the damper 5, the terminal portions 32 of each of the straps 1 are then bent, either upward or downward, depending upon orientation, at an approximate 90 degree angle, to engage the front wall surface 33, as shown in solid lines in FIG. 4. The damper 5 is thus securely retained within the wall opening 11, and the inventive installation system and method meets the "see through" test required of such installations due to the angle of the straps 1 and the sealing flanges 22 and 24.

The inventive system and method is intended primarily for use in dampers used within the air return path of HVAC systems, but is also applicable to fire and smoke dampers, outside air inlets, or for any installation in an opening where fluid flow needs to be regulated. With the inventive system, an installer need only carry a single type of installation kit which is universally usable for damper installations in any type of wall construction.

It is to be understood that while certain forms of the present invention have been illustrated and described herein, it is not to be limited to the specific forms or arrangement of parts described and shown.

What is claimed and desired to be secured by Letters Patent is as follows:

1. A damper mounting system for mounting a damper housing within a wall opening of a wall with a predetermined wall thickness, the damper housing including a top peripheral sealing flange extending upward from a front top surface thereof and a bottom peripheral sealing flange extending downward from a front bottom surface thereof, said system comprising:

a. a plurality of bendable straps which are separate from said damper housing, each said strap having a first leg which is longer than the thickness of the wall, a second intermediate leg which is approximately the length of the height of one of said sealing flanges and a third leg extending outward from said intermediate leg and which is considerably shorter than said first leg such that a said first leg can be folded over the wall surface and said second leg can be folded over one of said sealing flanges to thereby secure said damper within the wall opening.

2. A damper mounting system as in claim 1, wherein:

a. a first one of said straps is positioned atop said damper housing with the terminal end of the first leg of said first strap being folded upward along the wall surface and with the third leg of said first strap being folded downward over the top peripheral sealing flange of said damper housing; and b. a second one of said straps is positioned along a bottom surface of said damper housing with the terminal end of the first leg of said second strap being folded downward along the wall surface and with the third leg of said second strap being folded upward over the bottom peripheral sealing flange of said damper housing.

3. A damper mounting system as in claim 1, wherein:

a. a first pair of said straps is positioned atop said damper housing with the terminal end of the first legs of each strap in said first pair being folded upward along the wall surface and with the third leg of each strap in said first pair being folded downward over the top peripheral sealing flange of said damper housing; and b. a second pair of said straps is positioned along a bottom surface of said damper housing with the terminal end of the first leg of each strap in said second pair being folded downward along the wall surface and with the third leg of each strap in said second pair being folded upward over the bottom peripheral sealing flange of said damper housing.

4. A method of mounting a damper housing within a wall opening of a wall with a predetermined wall thickness, the damper housing including a top peripheral sealing flange extending upward from a front top surface thereof and a bottom peripheral sealing flange extending downward from a front bottom surface thereof, said method comprising the steps of:

a. providing a plurality of bendable straps which are separate from said damper housing, each said strap having:

i. a first leg which is longer than the thickness of the wall;

ii. a second intermediate leg which is approximately the length of the height of one of said sealing flanges; and iii. a third leg extending outward from said intermediate leg and which is considerably shorter than said first leg;

b. positioning a first one of said straps atop said damper housing with the intermediate leg of said first strap abutting said top peripheral sealing flange;

c. folding a terminal end of the first leg of said first strap over the wall surface; and d. folding the third leg of said first strap over said top peripheral sealing flange to thereby secure said damper within the wall opening.

5. A damper mounting method as in claim 1, and further comprising the step of:

a. positioning a second one of said straps atop said damper housing with the intermediate leg of said second strap abutting said bottom peripheral sealing flange;

b. folding a terminal end of the first leg of said second strap over the wall surface; and c. folding the third leg of said second strap over said bottom peripheral sealing flange.

6. A method of mounting a damper housing within a wall opening of a wall with a predetermined wall thickness, the damper housing including a top peripheral sealing flange extending upward from a front top surface thereof and a bottom peripheral sealing flange extending downward from a front bottom surface thereof, said method comprising the steps of:

a. providing a plurality of bendable straps which are separate from said damper housing, each said strap having:

i. a first leg which is longer than the thickness of the wall;

ii. a second intermediate leg which is approximately the length of the height of one of said sealing flanges; and iii. a third leg extending outward from said intermediate leg and which is considerably shorter than said first leg;

b. positioning a first pair of said straps atop said damper housing with the intermediate legs of each strap in said first pair abutting said top peripheral sealing flange;

c. folding a terminal end of the first legs of each strap in said first pair over the wall surface;

d. folding the third leg of each strap of said first pair over said top peripheral sealing flange;

e. positioning a second pair of said straps along a bottom surface of said damper housing with the intermediate legs of each strap in said second pair abutting said bottom peripheral sealing flange;

f. folding a terminal end of the first legs of each strap in said second pair over the wall surface; and g. folding the third leg of each strap of said second pair over said bottom peripheral sealing flange to thereby secure said damper within the wall opening.

* * * * *